US005357873A

United States Patent [19]

Hilton

[11] Patent Number: 5,357,873

[45] Date of Patent: Oct. 25, 1994

[54] COMPACT COMPUTER STAND

[76] Inventor: Carl Hilton, 3974 Highgate Rd., Muskegon, Mich. 49441

[21] Appl. No.: 916,695

[22] Filed: Jul. 22, 1992

[51] Int. Cl.[5] ..... A47B 35/00

[52] U.S. Cl. ..... 108/50; 108/92; 312/7.2

[58] Field of Search ..... 108/92, 93, 2, 50; 312/7.2

[56] References Cited

U.S. PATENT DOCUMENTS

| | | | |
|---|---|---|---|
| 4,359,947 | 11/1982 | Marschak | 108/1 |
| 4,567,835 | 2/1986 | Reese et al. | 108/92 |
| 4,619,427 | 10/1986 | Leymann | 108/92 |
| 4,625,657 | 12/1986 | Little et al. | 108/93 |
| 4,640,199 | 2/1987 | Zigman | 108/92 |
| 4,646,655 | 3/1987 | Robolin | 108/92 |
| 4,805,538 | 2/1989 | Fisher et al. | 108/92 |
| 4,861,121 | 8/1989 | Gotz | 312/7.2 |
| 4,884,773 | 12/1989 | Becker | 108/93 |
| 5,174,223 | 12/1992 | Nagy et al. | 108/50 |
| 5,199,773 | 4/1993 | Price, Jr. et al. | 312/7.2 |

FOREIGN PATENT DOCUMENTS

| | | | |
|---|---|---|---|
| 8203162 | 9/1982 | World Int. Prop. O. | 108/92 |

*Primary Examiner*—Michael J. Milano

*Attorney, Agent, or Firm*—Dorn, McEachran, Jambor & Keating

[57] ABSTRACT

A compact computer stand for use with home and office computer systems and associated components. A rectangular frame is supported by six legs. Disposed within the frame is an angled monitor shelf. The screen of a monitor resting upon the monitor shelf will be immediately above the keyboard at an angle. A longitudinal adjustment slot and corresponding stop bracket on the monitor shelf allow the depth of the monitor within the stand to be adjusted. A CPU shelf is disposed within the frame adjacent to the monitor shelf. Printer and paper trays are positioned at an angle above the monitor in a three-tiered structure. A keyboard tray is attached to the front of the stand frame. The left front leg of the stand is set back to allow the operator to pivot in and out of the stand without obstruction. Interchangeable auxiliary devices, such as document holders and paper trays, are attached at the front corners of the stand and are rotatable to a desired position.

12 Claims, 3 Drawing Sheets

COMPACT COMPUTER STAND

BACKGROUND OF THE INVENTION

Home and office computer stands, for housing computer systems and associated components, are not generally noted for their comfort or for their compact, efficient construction. The relative placement of components such as the keyboard, the CPU, the monitor and the printer require the operator to use excessive head and body motion in order to effectively operate and monitor each component. Often, all of the components are not housed within one stand, requiring the operator to leave the stand in order to operate and monitor such components. These factors combine to result in increased operator fatigue, decreased efficiency, and a diminished working environment quality.

SUMMARY OF THE INVENTION

The present invention overcomes these shortcomings by providing a stand capable of holding all necessary system components and which places each component within easy sight and reach of the operator. The stand is equipped to compactly house a keyboard, a monitor, a printer and associated paper trays, a CPU, and other auxiliary devices.

The monitor is placed on an angled monitor shelf disposed within the stand such that the monitor screen will be located immediately forward of the keyboard and at an angle, minimizing head and neck motion when the keyboard and monitor are viewed in sequence. The angled monitor has the additional advantage of reducing radiation impact on the operator. The printer and paper trays are placed immediately above the monitor and angled towards the operator, enabling the operator to operate and monitor the printer with a minimum amount of head or body motion.

A CPU shelf is disposed within the stand adjacent to the monitor shelf, out of the way but still within a convenient hand's reach of the operator. The keyboard tray is angled downward, reducing fatigue and tension in the operator's hands and wrists. Finally, detachable and interchangeable auxiliary devices are provided, such as mouse trays or document holders. These auxiliary devices are located at the corners of the stand and easily rotate out of the way when not in use.

These features combine to result in reduced operator fatigue, higher efficiency and an overall improvement in the quality of the working environment.

One purpose of the invention is to provide a stand of the type described with an angled monitor shelf, such that the monitor screen will be located immediately forward of the keyboard and at an angle, enabling the operator to view the keyboard and the screen in sequence with little or no movement of the head or neck.

Another purpose of the invention is to provide a stand with printer and paper trays positioned at an angle directly above the monitor, enabling the operator to operate the printer with a minimum of head or body movement.

Another purpose of the invention is to provide a stand with a CPU shelf or compartment disposed within the stand adjacent to the monitor shelf and within easy reach of the operator.

Another purpose of the invention is to provide a stand with the legs placed in a formation which allows the operator to pivot in and out of the stand with ease and without obstruction.

Another purpose of the invention is to provide detachable, interchangeable auxiliary devices, such as document holders or mouse trays, which are easily installed into the stand and which may be rotated out of the way when not in use.

Other purposes will appear in the ensuing drawings, specification and claims.

DETAILED DESCRIPTION OF THE INVENTION

Figure 1:
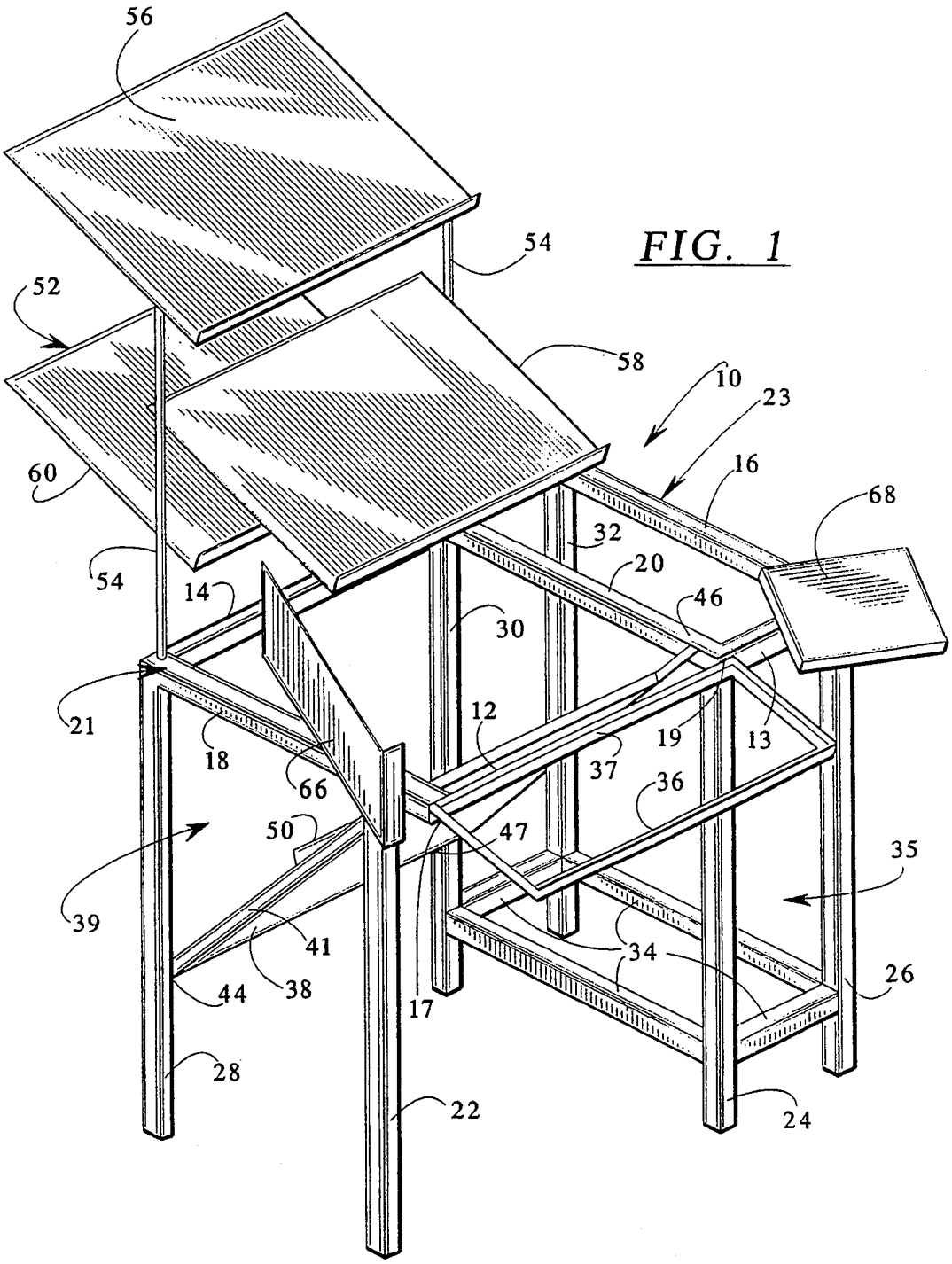
FIG. 1 is a perspective view of the compact computer stand of the present invention.

The compact computer stand is illustrated in perspective in FIG. 1. The stand has a horizontal frame 10 formed of a plurality of horizontal frame members. The frame members include a right front beam 13, a left rear beam 14, a right rear beam (not shown), a right side beam 16 and a left side beam 18. A middle beam 20 divides frame 10 into two sections. Each of the beams is a hollow, rectangular tube.

Left frame section 21, bounded by beams 14, 18 and 20, defines the upper boundary of a computer monitor compartment 39. In this embodiment, the dimensions of frame section 21 are approximately 18.25″×20″. Right frame section 23, bounded by beams 13, 16, 20 and the right rear beam, defines the upper boundary of a CPU compartment 35. In this embodiment, the dimensions of frame section 23 are approximately 7″×20″.

Six legs elevate and support the horizontal frame members. Each leg is approximately 26.5″ in length. Left front leg 22 is positioned along left side beam 18, set back a distance from the front end 17 of beam 18. This set-back allows the operator to pivot in and out of the computer stand with ease and without obstruction. The set-back is more clearly seen in FIG. 2, an elevation of the left side of the computer stand. In this embodiment, left front leg 22 is set back approximately 3.5″.

The locations of the other legs are as follows. Middle front leg 24 is located at the intersection of right front beam 13 and middle beam 20. Right front leg 26 is located at the corner formed by right front beam 13 and right side beam 16. Left rear leg 28 is located at one rear corner defined by left side beam 18 and left rear beam 14. Middle rear leg 30 is located at the intersection of left rear beam 14, the right rear beam and middle beam 20. Finally, right rear leg 32 is located at the other rear corner defined by right side beam 16 and the right rear beam.

Front legs 24, 26 and rear legs 30, 32 are joined near their bases by four CPU base braces 34. Braces 34 are all placed approximately 4.75″ above the bottom of the legs in a rectangular formation. A CPU compartment 35 is defined by right frame section 23, legs 24, 26, 30 and 32, and base braces 34. A CPU (not shown) may be placed within compartment 35, resting on braces 34 themselves or alternatively, resting on a plate placed upon braces 34.

Figure 2:
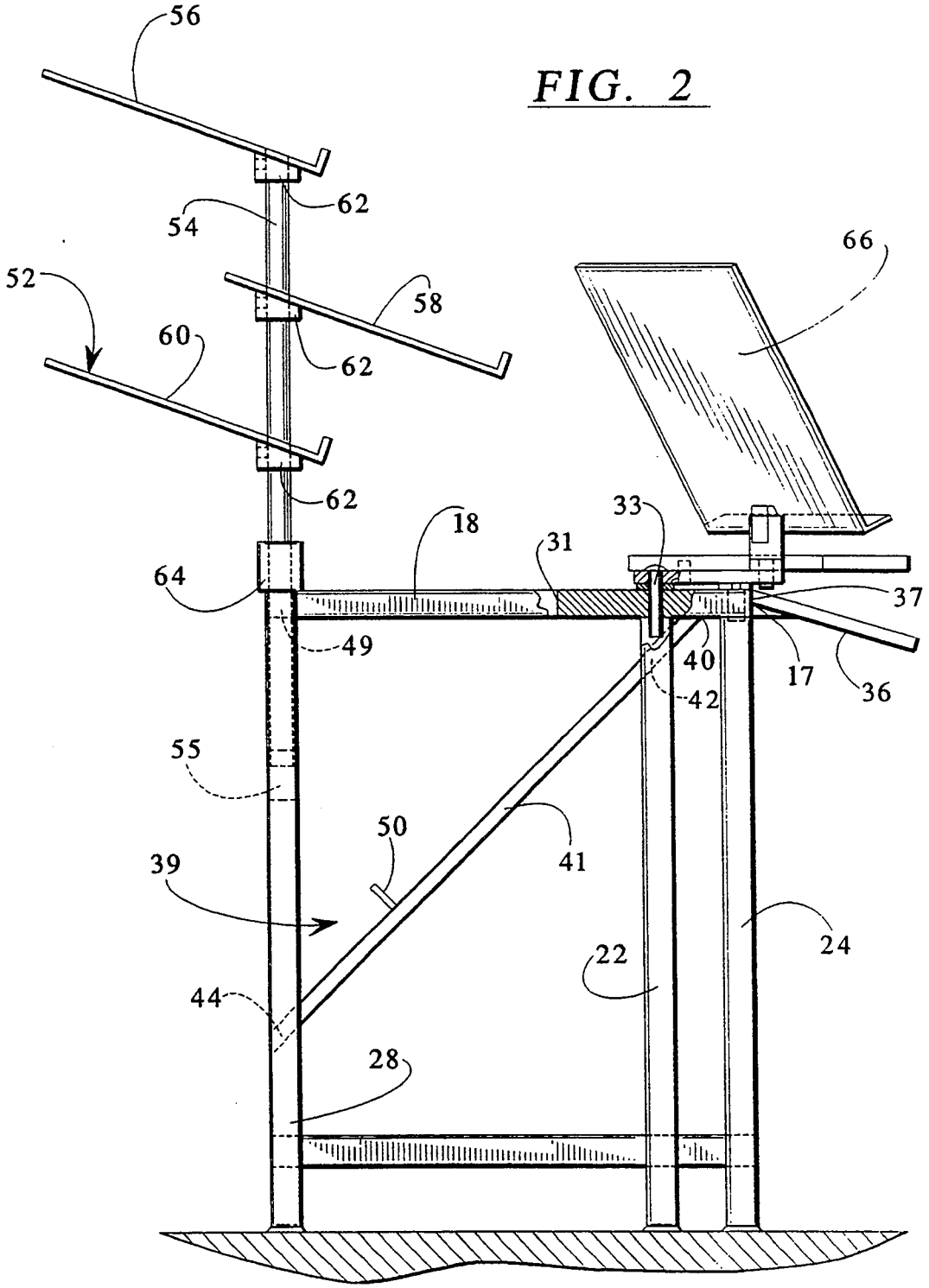
FIG. 2 is a side elevation view of the compact computer stand.

A keyboard tray 36 is attached across the open front portion of left frame section 21. In FIG. 2, it can be seen that tray 36 projects outwardly from the computer stand at a slight downward angle; approximately 15 degrees in this embodiment. This angle allows the operator to position his or her hands more comfortably while using the keyboard. Tray 36 may have dimensions of approximately 18.5"×7.25".

Tray 36 is attached to the computer stand by means of two extensions which project in telescoping relation from tray 36 into the beams 18 and 20. A left extension 31 (FIG. 2) enters left side beam 18 at 17, and a right extension (not shown) enters middle beam 20 at 19. A bore is formed through each extension. The bore through the left extension is formed such that it will be located directly above left front leg 22 (which is hollow) when tray 36 is in place. A corresponding bore is formed in left side beam 18, such that tray 36 may be secured by passing a pin 33 through the bores formed in beam 18 and the left extension 31 of tray 36, and into leg 22. As will be described later, auxiliary devices, such as document holder 66, may be also be secured by pin 33.

Similarly, corresponding bores are formed above middle front leg 24 (at the intersection of beams 20 and 13) and through the right extension of tray 36. A pin passes through these bores and into leg 24 to hold the right side of tray 36 in place.

A monitor cavity 39 is defined by left frame section 21 and legs 22, 24, 28 and 30. Monitor shelf 38 is disposed within monitor cavity 39. A first angle iron 41 is attached to leg 22 at 42 and leg 28 at 44 (FIG. 2). A second angle iron is attached to beam 20 at 46 and leg 30 at 47. Shelf 38, resting on and attached to the first and second angle irons, slopes downward through the cavity at an angle of approximately 45 degrees. The leading edge of shelf 38, shown in FIG. 2 at 40, is placed in close proximity to the back edge 37 of keyboard tray 36. The monitor screen, when placed upon shelf 36, will be located at an angle immediately forward of the keyboard, allowing the operator to view the keyboard and monitor screen sequentially with little or no head or neck movement.

Figure 3:
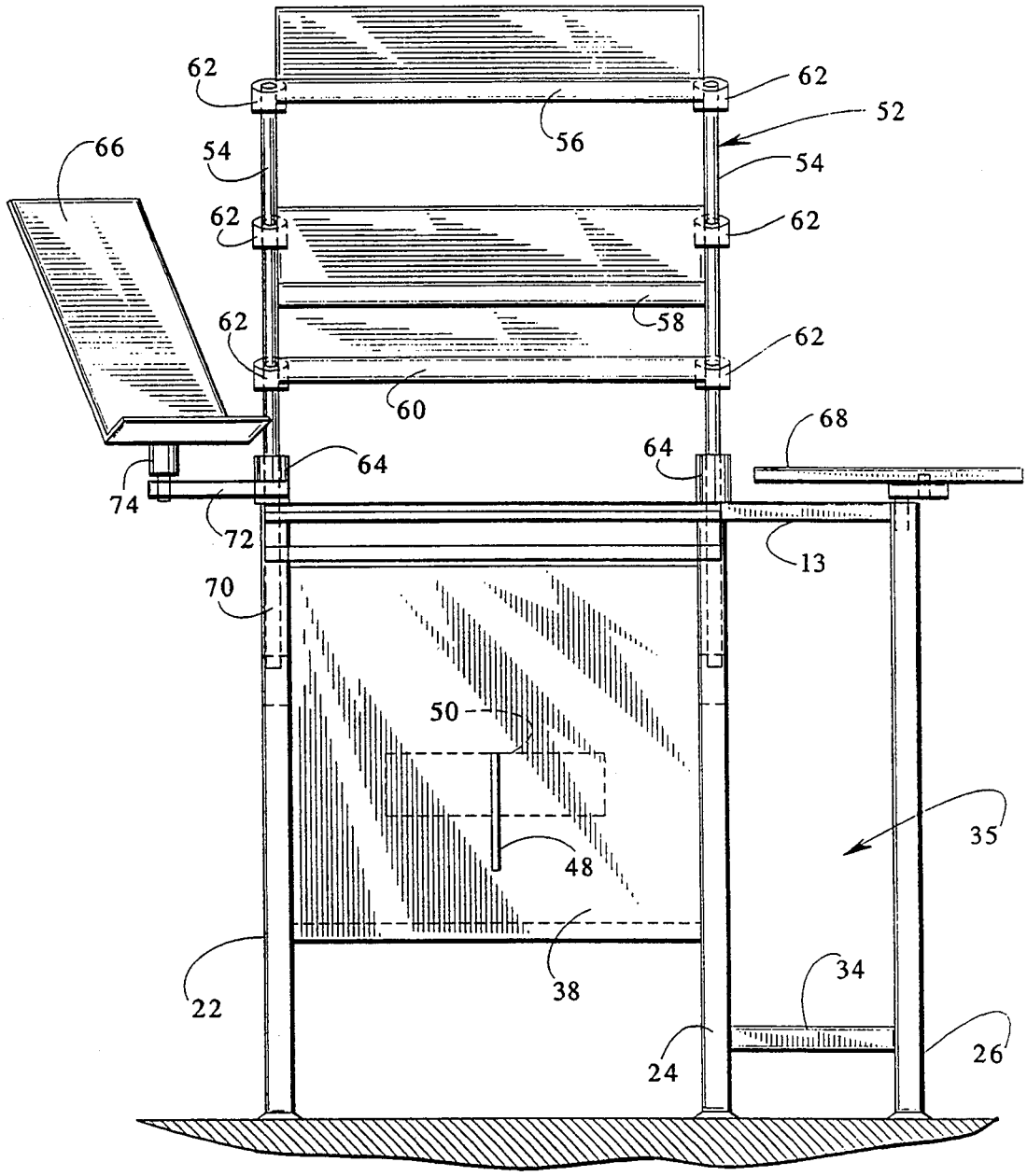
FIG. 3 is a front elevation view of the compact computer stand.

As shown in FIG. 3, a medial longitudinal adjustment slot 48 is formed in monitor shelf 38. Slot 48 receives a movable stop bracket 50. Bracket 50 rests against the rear of a monitor placed on shelf 38 to prevent the monitor from sliding off of the shelf. The depth of the monitor within monitor compartment 39 may be varied by adjusting the position of stop bracket 50 along slot 48.

A printer shelf structure 52 is attached at the rear of frame 10. The construction of the joints between beam 14 and legs 28 and 30 facilitate the installation of two printer shelf structure support rods 54. The intersection of beam 14 with leg 28 will be described in full detail. The intersection of beam 14 with leg 30 is identical.

A tab 49 (shown by phantom lines in FIG. 2) closes off much of the hollow interior of leg 28. Tab 49 has a circular opening of approximately 0.640" diameter formed in its center. A corresponding circular bore of the same diameter is formed through the left end of beam 14, such that when beam 14 is in place, the opening in tab 49 and the bore in beam 14 will line up. The side of leg 28 which faces beam 14 is open for approximately 0.875" from the top of leg 28, allowing the left end of beam 14 to rest upon tab 49.

Support rod 54 has a diameter slightly less than that of the bores formed through tab 49 and beam 14, allowing rod 54 to pass through the bores and into leg 28. The length of rod 54 disposed within leg 28 (and, ultimately, the height of printer shelf structure 52) may be set by tightening adjustment collar 64. The lower end 55 of rod 54 (FIG. 2) has a diameter slightly larger than that of the circular opening in tab 49, limiting the height to which rod 54 may be raised. Thus, rod 54 performs the dual function of supporting printer structure 52 and of holding the intersection of leg 28 and beam 14 together. An identical rod 54 is passed through the intersection of beam 14 and leg 30 in like fashion.

Attached between rods 54 are three printer shelves: paper run-out shelf 56, printer shelf 58 and paper feed shelf 60. The printer shelves are in a three-tiered arrangement and slope at approximately a 20 degree angle to horizontal. A printer and paper trays placed on the shelves will be immediately above and behind the monitor, enabling the operator to set up, operate and watch the printer with a minimum of head and body movement.

FIGS. 2 and 3 show that the printer shelves are supported on rods 54 by adjustment collars 62. The vertical position of the shelves between rods 54 may be varied by loosening set screws in the collars 62, moving the shelves to a desired position, and then retightening the collars.

As mentioned earlier, the bore formed in left side beam 18, directly above left front leg 22, facilitates the installation of auxiliary devices. An additional bore serving the same purpose is formed directly above right front leg 26. Typical auxiliary devices include document holders, mouse trays and stationery holders. These devices are detachable and may be easily installed in either bore.

Installed document holder 66 and mouse tray 68 are shown in the drawings. The operation of document holder 66 is as follows. A rod 70 is inserted into the bore formed in left side beam 18. Rotatably attached to rod 70 is arm 72. Document holder 66 is rotatably attached to arm 72 at 74. There are two pivot points: arm 72 may be rotated about rod 70, and document holder 66 may be rotated about arm 72. Thus, the document holder is easily set to a desired configuration and is easily rotated out of the way when not in use. Mouse tray 68 operates in an identical manner. Other devices, such as a stationery tray, for example, could be attached to the stand in similar fashion.

Whereas the preferred form of the invention has been shown and described herein, it should be realized that there may be many modifications, substitutions and alterations thereto without departing from the scope of the following claims.

The embodiments of the invention in which an exclusive property or privilege is claimed are defined as follows:

1. A compact computer stand comprising a rectangular frame supported by at least four legs; a monitor compartment disposed within said stand; an angled monitor shelf disposed within said monitor compartment; means for adjusting the depth within said monitor compartment of a monitor placed on said monitor shelf; a CPU compartment disposed within said stand; a printer shelf structure attached to and above said frame; said printer shelf structure comprising a vertical tier of shelves suspended between two supporting rods, said shelves being inclined downward in a non-perpendicular orientation relative to said supporting rods; and a keyboard tray attached to the front of said frame.

2. The compact computer stand of claim 1 wherein said means for adjusting the depth of a monitor comprise a movable stop bracket received by a longitudinal adjustment slot formed in said monitor shelf.

3. The compact computer stand of claim 1 wherein at least one of said legs is not located at a corner of said frame.

4. The compact computer stand of claim 1 further characterized by means for varying the relative vertical position of said angled shelves between said supporting rods.

5. The compact computer stand of claim 4 wherein said means for varying said relative vertical position of said angled shelves comprises adjustment collars fixably attached to said angled shelves and vertically movable along said supporting rods.

6. The compact computer stand of claim 1 wherein said keyboard tray is inclined downwards at a slight angle.

7. The compact computer stand of claim 1 further characterized by detachable, rotatable auxiliary devices which are attached at points along said frame.

8. The compact computer stand of claim 4 wherein said auxiliary devices include document holders, mouse trays and stationery holders.

9. The compact computer stand of claim 1 wherein said shelves are inclined downward relative to said supporting rails at approximately a twenty degree angle.

10. The computer stand of claim 9 wherein there are three of said shelves.

11. The computer stand of claim 1 wherein said keyboard tray is inclined downward relative to said rectangular frame.

12. The computer stand of claim 1 wherein said keyboard tray is inclined at approximately a fifteen degree angle.

* * * * *